US005472027A

United States Patent [19]

Ackerman

[11] Patent Number: 5,472,027

[45] Date of Patent: Dec. 5, 1995

[54] LOG BARK SLITTING MACHINE

[75] Inventor: Robert T. Ackerman, Seattle, Wash.

[73] Assignee: Nicholson Manufacturing Company, Seattle, Wash.

[21] Appl. No.: 349,030

[22] Filed: Dec. 2, 1994

[51] Int. Cl.[6] ..... B27L 1/00

[52] U.S. Cl. ..... 144/208 E; 144/208 R; 144/341

[58] Field of Search ..... 144/208 R, 208 E, 144/341

[56] References Cited

U.S. PATENT DOCUMENTS

| | | | |
|---|---|---|---|
| 2,788,034 | 4/1957 | Brundell et al. | 144/208 E |
| 3,991,800 | 11/1976 | Palmquist | 144/208 E |
| 4,657,056 | 4/1987 | Hutson | 144/208 E |

FOREIGN PATENT DOCUMENTS

| | | | |
|---|---|---|---|
| 1376318 | 12/1964 | France | 144/208 E |
| 2212158 | 9/1972 | Germany | 144/208 E |
| 167467 | 6/1989 | Sweden | 144/208 E |

*Primary Examiner*—W. Donald Bray
*Attorney, Agent, or Firm*—Seed and Berry

[57] ABSTRACT

A bark slitting machine has swing mounted slitting arms on a rotating ring through which a log is fed. The arms have a swept back outer portion with a cutting edge and an attack angle having a size preferably like that of the lead angle of a helix determined by the path of a point rotating at a given rotational speed about the circumference of a log advancing at a given linear speed.

19 Claims, 6 Drawing Sheets

LOG BARK SLITTING MACHINE

TECHNICAL FIELD

The present invention relates to slitting machines for slitting the bark on a log in a helical pattern prepatory to debarking the log.

BACKGROUND OF THE INVENTION

U.S. Pat. No. 3,991,800 discloses the concept of slitting the bark on a log in a helical pattern and than peeling off the bark in a continuous operation. This technique is particularly effective for removing bark having relatively long stringy fibers such as present on cedar and eucalyptus trees. The bark slitting is disclosed as being performed by a ring-type debarker having modified tools on its swing arms. The slitting operation cuts through the stringy fibers at regular intervals so that the bark can then be peeled cleanly from the log in a helical strip. The modified debarker is positioned in advance of a standard ring-type debarker so that the logs pass axially through both machines.

It is preferred to have the slit through the bark made during the bark slitting operation be performed such that the bark adjoining the slit is not scuffed and partially peeled. Otherwise, the stringy bark tends to bunch and foul the bark slitting ring.

Bark thickness and resistance to cutting also varies. Hence, it is preferred to be able to control the cutting pressure so as to cleanly cut through the bark, and yet not unduly score the underlying wood. A further need is ease of removing the slitting tools for sharpening or replacement.

SUMMARY OF THE INVENTION

With the foregoing in mind the present invention utilizes a standard ring-type debarker having debarker arm pressure adjustment during operation and substitutes novel slitting arms for the debarker arms. Each slitting arm has a removeable cutting knife with an elongated cutting edge extending from the outer end of the arm toward the swing axis of the arm. Preferably the cutting edge is straight and coincides with a line passing through the swing axis. Each slitting arm is bent in a rearward direction, i.e., the travel direction of the logs, at a location sufficiently close to the pivot axis of the arm that the entire length of the cutting edge is contained in the rearwardly bent part of the arm. The degree of bend of the arm preferably matches the expected lead angle of the helical path of a point traveling around a log at ring rotational speed while the log advances axially at a predetermined speed. The lead angle of the helical path varies with the log diameter for a given ring speed and log speed, and hence it is preferred to have the degree of bend in the slitting arm approximate the lead angle for an intermediate expected log diameter. It has been found that this normally is close enough to prevent bark removal during the bark slitting operation.

As an alternative arrangement, the rearwardly bent part of slitting arm may be hinged to the remaining part of the arm rather than being rigidly connected. This arrangement permits the cutting edge to automatically find the correct cutting position with respect to the helix. Stops are provided to limit relative movement between the hinged parts of the splitting arm.

Although a straight cutting edge is preferred for production economy, the cutting knife may have a concave or convex configuration.

DETAILED DESCRIPTION OF THE INVENTION

Figure 1:
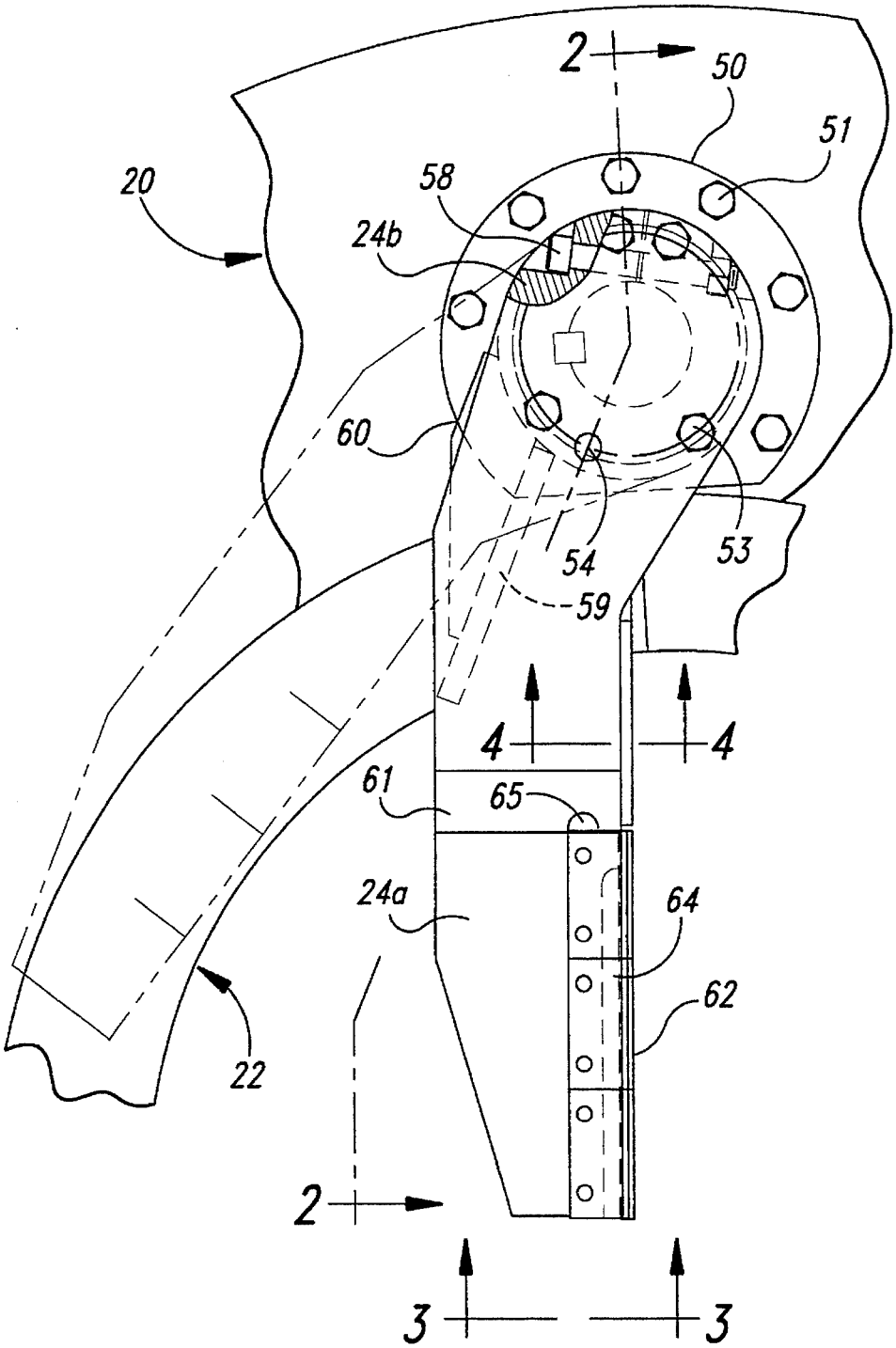
FIG. 1 is a fragmentary elevational view of a bark slitting machine embodying the present invention and showing one of the slitting arms.
Figure 2:
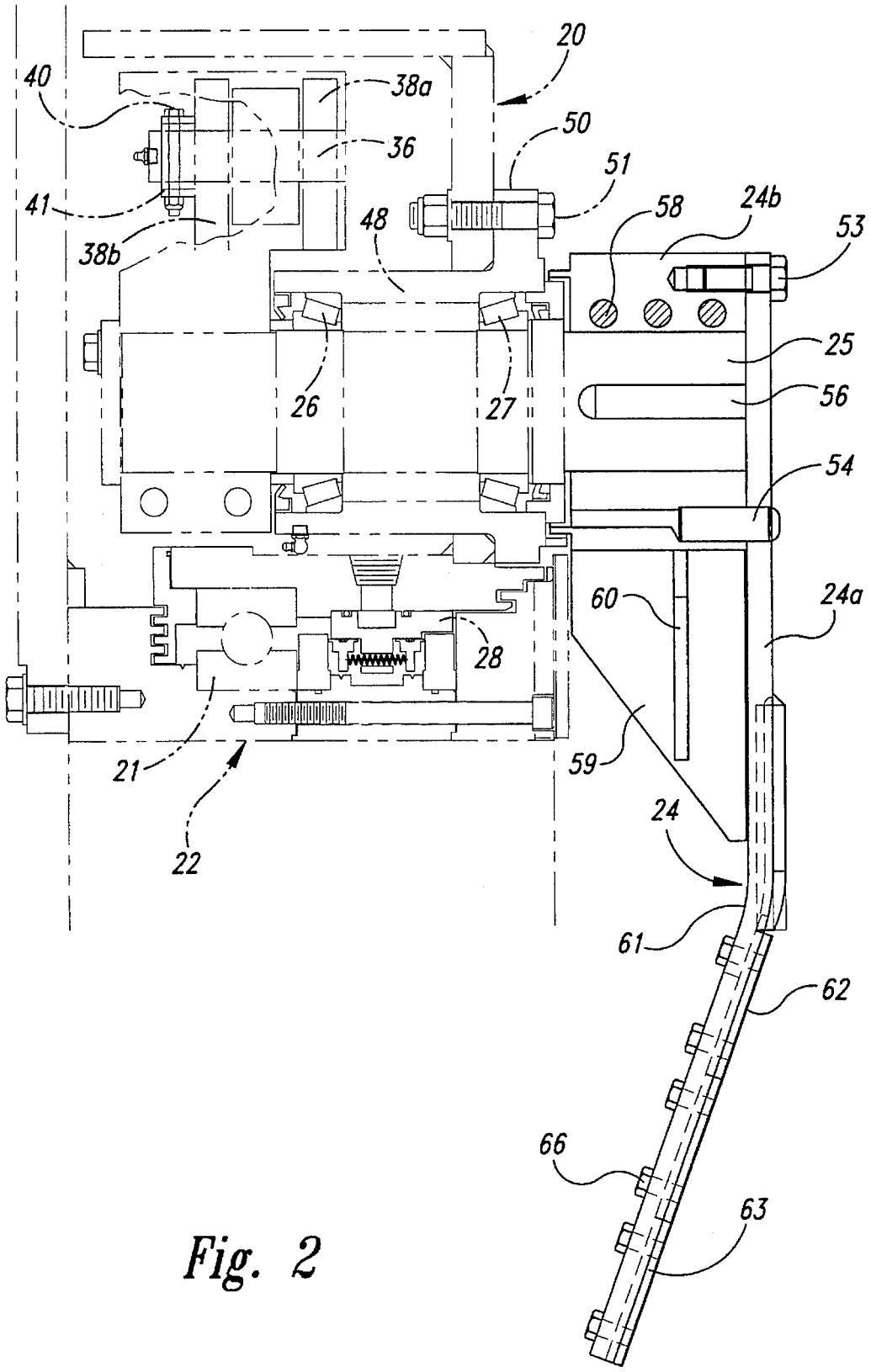
FIG. 2 is a fragmentary sectional view taken as indicated by line 2—2 in FIG. 1 and with the parts of a standard debarker on which the slitting arms are mounted being shown in phantom.
Figure 3:
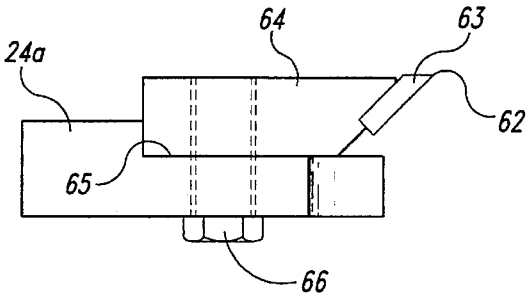
FIG. 3 is an enlarged end view of the outer end of one of the splitting arms.
Figure 4:
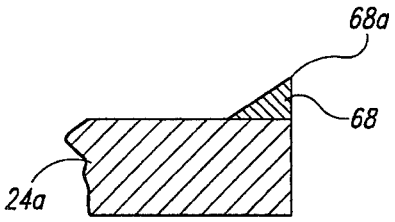
FIG. 4 is a a fragmentary sectional view taken as shown by line 4—4 in FIG. 1.
Figure 5:
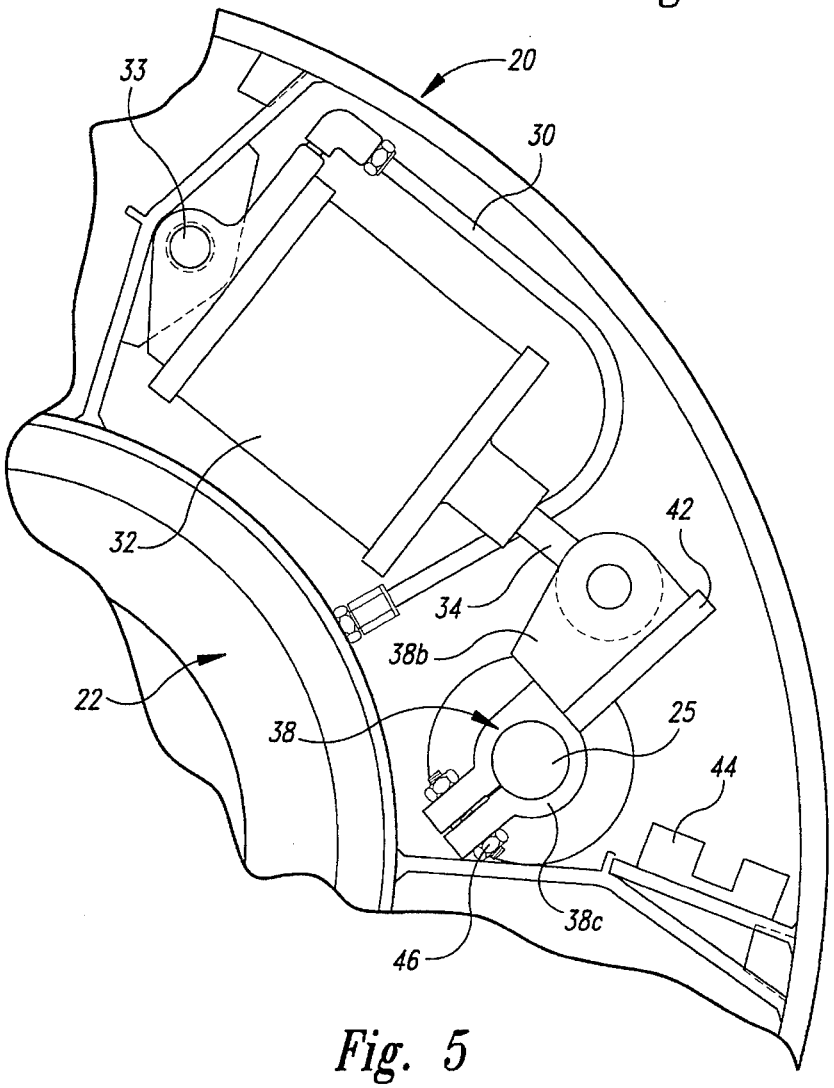
FIG. 5 is a fragmentary view of the back side of the machine.

In accordance with the present invention a commercially available ring-type debarker, such for example, as a Nicholson A5A debarker with an air seal ring manufactured by the Nicholson Manufacturing Company, Seattle, Wash., may be modified by substituting the slitting arms of the present invention, for the debarking arms to produce a slitting machine. Such a converted debarker has an outer rotating ring 20 mounted by a bearing 21 on an inner stationary ring 22 through the front of which a log is fed by a suitable conveyor to move endwise from an infeed side (front side) of the machine to an outfeed side (rear side) therefrom. The slitting arm units 24 are swing mounted on pivot shafts 25 mounted by a pair of central sealed bearings 26–27 on the outer ring 20.

Preferably the rings 20, 22 provide therebetween an annular air plenum 28 having a compressed air supply whose pressure is operator controlled by valves at a control station. The air plenum is connected by air lines 30 to one end of cylinders 32 which are pivotally mounted at that end to the outer ring at 33. The other end of each cylinder is vented. A piston rod 34 extends from the vented end of each cylinder 32 and is journaled on a respective pivot pin 36 between the forks 38*a*–38*b* of a forked lever 38 having a split hub 38*c* at its other end. The fork 38*b* at the outfeed side is connected to the pivot pin 36 by a bolt 40 passing through the pivot pin 36 and through ring 41 projecting from the outfeed side of the fork 38*b*. The forks 38*a*, 38*b* are joined by a stop element 42 arranged to engage a bumper 44 which is mounted on a stationary flange 45 fixed to the outer ring. This bumper limits inward swing of the respective slitter arm to a set distance from the center axis of the rings 20, 22, as for example, a distance of 1.5 inches.

The split hub 38*c* of each lever 38 is clamped by bolts 46 on the outfeed end of a respective pivot shaft 25. The central bearings 26–27 on this shaft are mounted in a boss 48 projecting in the outfeed direction from a mounting plate 50 bolted at 51 to the outer ring 20. Each pivot shaft 25 projects at the infeed side of the machine to receive the hub of a respective slitting arm unit 24 comprising a slitting arm 24*a* and a hub 24*b*. The slitting arm 24*a* is secured by bolts 53 and a dowel 54 to the hub. The hub 24*b* is split and is keyed at 56 to the shaft. Bolts 58 clamp the hub 24*b* in position on the shaft 25. It is preferred to provide the hub 24*b* with a gusset plate 59 braced by a flange 60 to resist flexing of the slitting arm in the outfeed direction.

Basic to the present invention is providing each slitting arm 24*a* with a rearwardly sweeping cutting portion which is bent at 61 adjacent the gusset 60 in the rearward direction toward the outfeed side of the ring. A cutting edge 62 is provided on the cutting portion of each slitting arm, preferably by carbide inserts 63 mounted in holders 64 seated end on end in a recess 65 formed in the arm 24*a*. Each insert holder 64 is secured by a pair of cap screws 66 to the slitting arm and has a sloped face 64*a* facing toward the incoming logs. This face has an outer recess in which a sharpened carbide is mounted. Preferably a stainless steel rod 68 is welded in position on the slitting arm to extend from the carbide inserts 63 past the bend 61 in the slitting arm and is sharpened to an edge 68*a* facing the incoming logs. This edge assists in giving the swing arm a self-opening characteristic when a log of relatively large diameter is being processed.

Centrifugal force urges each swing arm 24*a* to swing outwardly responsive to rotation of the outer ring 20. This outward force is countered by pressurizing the air cylinders 32 so that their piston rods 34 extend and swing the levers 38 such as to rotate the pivot shafts 25 in the direction swinging the slitting arms inwardly toward the center of the rings 20, 22. The pressure in the plenum 28 connected to the air cylinders 32 by the lines 30 is selected to provide an inward cutting force on the slitting arms adequate to force the cutting edges 62 through the bark of the log being processed, and still not sufficient to prevent self-opening of the arms or objectionable scoring of the wood beneath the bark.

Figure 6A:
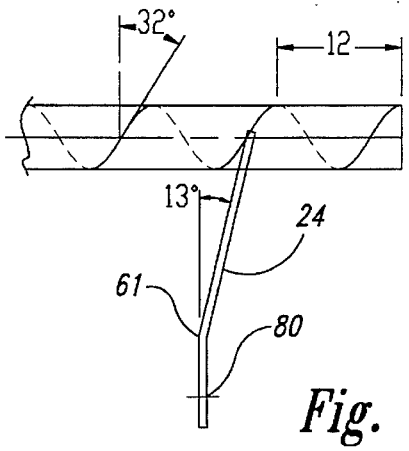
FIGS. 6A, 6B and 6C illustrate the helical slitting paths cut on various sizes of logs when the log speed and rotational speed of the ring are constant.
Figure 7A:
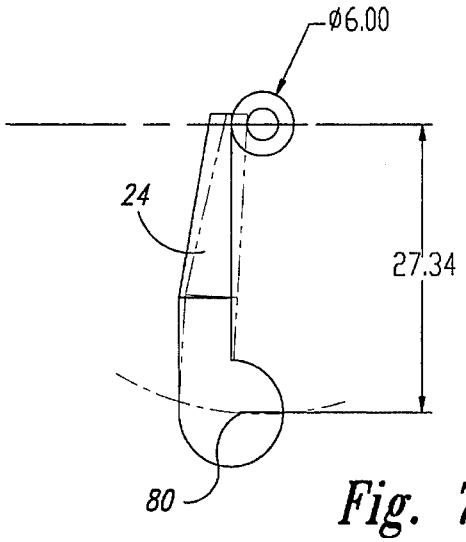
FIGS. 7A, 7B and 7C correspond to FIGS. 6A, 6B and 6C and are end views showing the corresponding slitting arm positions.
Figure 6B:
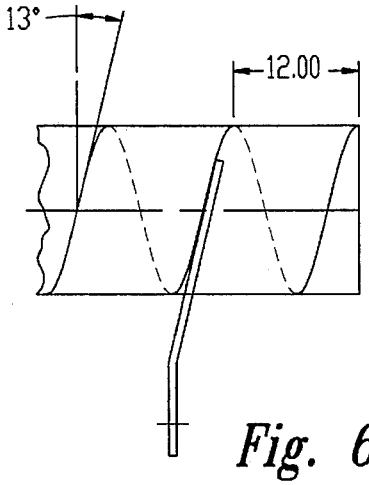
Figure 7B:
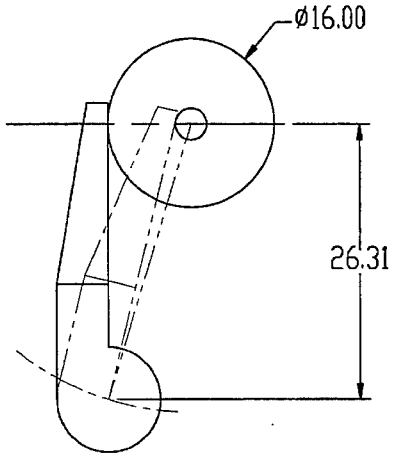
Figure 6C:
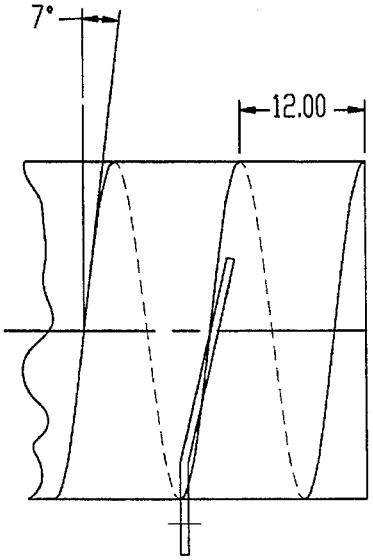
Figure 7C:
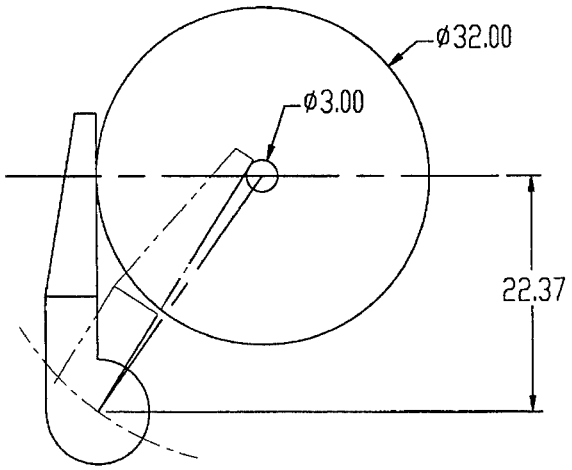

When the slitting machine is in operation the slitting arm units 24 are initially positioned in front of the oncoming log to be processed by adjusting at the control station the air pressure in the air plenum 28 between the rings 20,22 while the outer ring 20 is driven at a preselected rotational speed. The forward end of the advancing log strikes the arms and the resulting impact forces cause the slitting arms to self-open until the cutting edge 62 of each arm reaches the bark, whereupon the cutting edge slits the bark in a helical path having a lead angle determined by the lineal speed of the advancing log, the rotational speed of the outer ring and the diameter of the log. For a given log advancing speed and ring rotational speed, the lead angle increases as log diameter decreases. This is illustrated in FIGS. 6A–6C wherein progressively larger logs are shown each being advanced 12 inches, for example, during each rotation of the ring. The swing arm 24 is given a rearward sweep for the cutting edge of 13 degrees for purposes of example. This corresponds to the lead angle of the helical path of the cutting edge of each swing arm as an intermediate sized log 16 inches in diameter passes through the ring as indicated in FIG. 6B. As shown in FIG. 6A, when a small log 6 inches in diameter is passing through the ring the lead angle increases to 32 degrees. FIG. 6C illustrates passage of a relatively large log which is 32 inches in diameter giving a lead angle of 7 degrees. FIGS. 7A–7C show an end view of the oncoming logs shown in FIGS. 6A–6C, respectively, and the corresponding slitting position of the slitting arms.

Ideally the bend in the swing arms is selected to have an angle corresponding to the lead angle of the helical slit being cut into the log. Since this lead angle varies with log diameter, for a given log feed speed and ring rotational speed, it is preferred to select a lead angle corresponding to the lead angle for the helical cut on a log having a lead angle approximating the lead angle for the diameter of the average sized log being processed.

Figure 9:
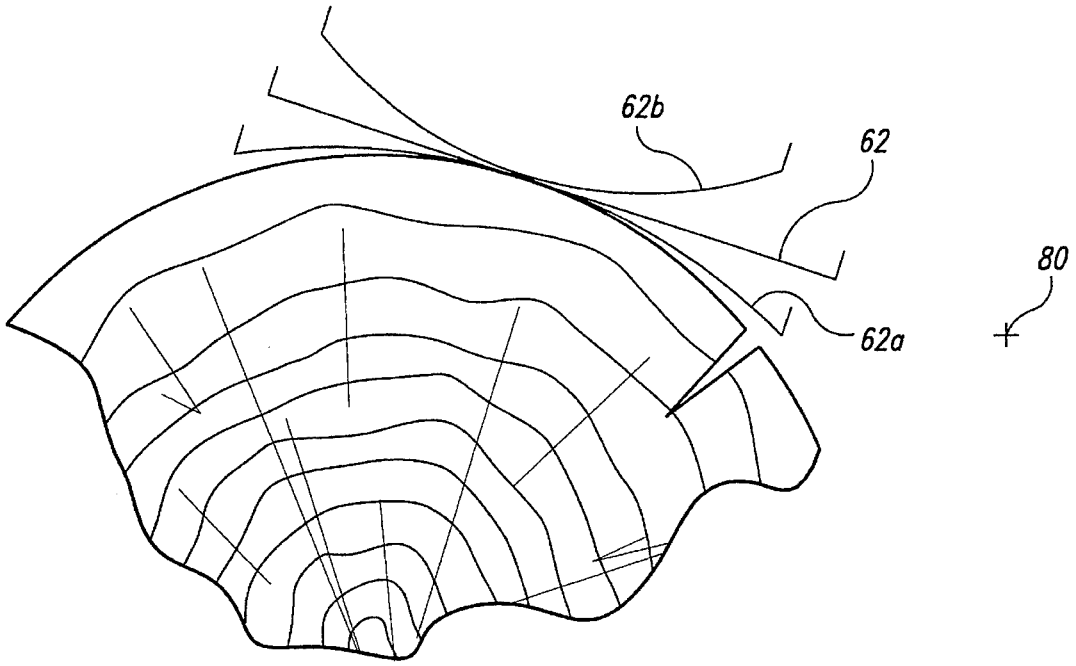
FIG. 9 illustrates alternative cutting edge configurations for the slitting arms.

It is preferred to having the cutting edge on the slitting arms straight for convenience of manufacture of the carbide inserts 64, and to have each cutting edge 62 on a straight line passing through the swing axis 80 of the respective slitting arm. However, as indicated in FIG. 9, by lines 62*a* and 62*b*, the cutting edge can also be made convex or concave, respectively. If the cutting edge is concave, the radius of curvature of the concave edge 62*b* should be at least as great as the radius of the largest log to be processed.

Figure 8A:
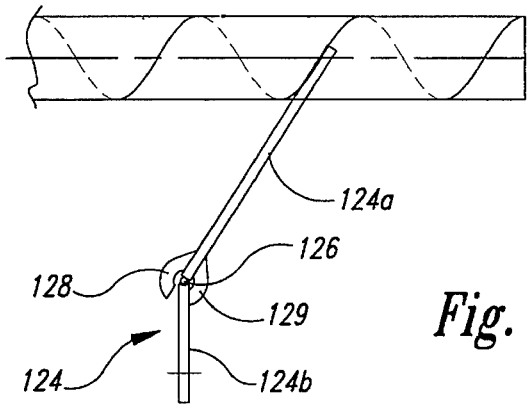
FIGS. 8A, 8B and 8C correspond to FIGS. 6A, 6B and 6C, and illustrate the slitting action of a modified slitting arm which is articulated.
Figure 8B:
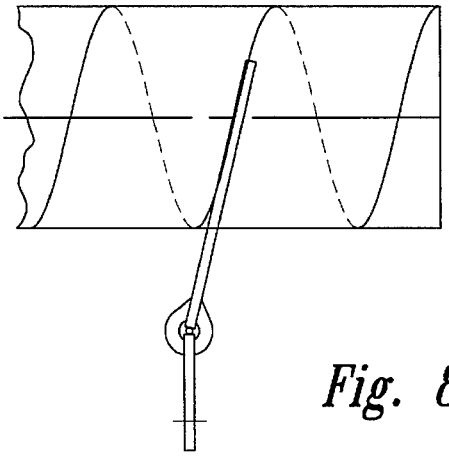
Figure 8C:
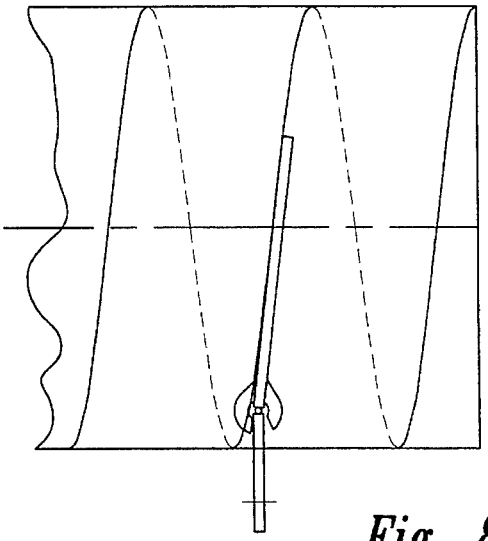

As indicated by slitting arm 124 in FIGS. 8A–8C, the slitting arms may be articulated so that the outer part 124*a* of the arms containing the cutting edge is free to swing about a hinge axis 126 relative to the hub portion 124*b* of the slitting arm 124. Stops 128–129 are provided at the hinge axis 126 to limit swinging movement of the outer slitting part 124*a* of the arms. When in operation the articulated slitting arms 124 tend to articulate to a bend angle at the articulation 126 which is equal to the lead angle of the helical slit generated for the log being processed. This is illustrated in FIGS. 8A–8C.

From the foregoing it will be appreciated that, although specific embodiments of the invention have been described herein for purposes of illustration, various modifications may be made without deviating from the spirit and scope of the invention. Also, although conversion of a Nicholson A5A debarker to a bark splitting machine has been used as an example, it will be appreciated that other ring-type debarkers can be readily converted, as for example, those disclosed in U.S. Pat. Nos. 3,190,327 and 4,566,371. Accordingly, the invention is not limited except as by the appended claims.

I claim:

1. A log bark slitting machine for slitting in a helical path the bark of logs each having a diameter within a given diameter size range, said machine comprising:

a rotary ring having a central opening therethrough with a center axis for passing an axially moving log in a forward direction; and a swing arm having an elongated bark cutting edge, said arm being pivotally mounted on said ring such that the arm can swing inwardly into said central opening about a swing axis parallel to said center axis for engagement of said knife with the bark on a said log, said cutting edge facing toward said central axis and extending lengthwise from an outer end portion of said swing arm toward said ring, and said swing arm being swept rearwardly through at least the length of said cutting edge at an attack angle relative to a plane perpendicular to said central axis, said attack angle having a size approximating that of the lead angle of a helix determined by the path of a point rotating at a given rotational speed about the circumference of a said log advancing axially at a given speed.

2. A log bark slitting machine according to claim 1 in which an extension of a line along said cutting edge passes through said swing axis.

3. A log bark slitting machine according to claim 1 in which means is provided on said ring for urging said arm to swing inwardly.

4. A log bark slitting machine according to claim 1 in which adjustable means is provided on said ring for urging said arm to swing inwardly at variable slitting pressures, while the ring is turning.

5. A log bark slitting machine according to claim 1 in which said ring has a plurality of said pivotally mounted arms.

6. A log bark slitting machine according to claim 1 in which said cutting edge is provided by carbide inserts detachably mounted on said arm for ease of replacement.

7. A log bark slitting machine according to claim 1 in which an outer part of said arm containing the full length of said cutting edge is swing mounted on the remaining part of the arm for varying said helix angle.

8. A log bark slitting machine according to claim 7 in which the swing of said outer part relative to said remaining part is limited to a given swing range.

9. A log bark slitting machine according to claim 7 in which said outer part is free to swing in a given swing range.

10. A log bark slitting machine according to claim 1 in which said cutting edge is straight.

11. A log bark slitting machine according to claim 1 in which said cutting edge is convex along its length.

12. A log bark slitting machine according to claim 1 in which said cutting edge is concave along its length.

13. A bark slitting tool comprising:

a swing arm having a boss at one end defining a swing axis, a cutter assembly mounted on said arm and presenting an elongated straight cutting edge extending from the opposite end of said arm toward said boss, a portion of said arm containing said cutter assembly being bent at an angle relative to a portion of said arm containing said boss such that said cutting edge is parallel to a line intersecting said swing axis at an acute angle.

14. A bark slitting tool according to claim 13 in which said cutting edge coincides with said line.

15. A bark slitting tool according to claim 13 in which said arm portion which is bent is hinged to swing relative to said arm portion containing the boss.

16. A bark slitting tool according to claim 13 in which said swing arm is detachably mounted on said boss.

17. A bark slitting tool according to claim 13 in which said cutter assembly comprises a holder detachably mounted on said swing arm and a carbide insert on said holder.

18. A bark slitting machine according to claim 13 in which said cutter assembly comprises a row of aligned holders detachably mounted on said swing arm, each of said holders having a carbide insert, said carbide inserts providing said cutting edge.

19. A bark slitting tool comprising:

a swing arm having a boss at one end defining a swing axis, a cutter mounted on said arm and presenting an elongated straight cutting edge extending from the opposite end of said arm toward said boss, a portion of said arm containing said cutter being hinged to swing at an angle relative to a portion of said arm containing said boss.

* * * * *